US012163666B2

(12) United States Patent
Hoskin

(10) Patent No.: US 12,163,666 B2
(45) Date of Patent: Dec. 10, 2024

(54) PORTABLE STOVE

(71) Applicant: Brice Hoskin, Crested Butte, CO (US)

(72) Inventor: Brice Hoskin, Crested Butte, CO (US)

( * ) Notice: Subject to any disclaimer, the term of this patent is extended or adjusted under 35 U.S.C. 154(b) by 566 days.

(21) Appl. No.: 17/501,796

(22) Filed: Oct. 14, 2021

(65) Prior Publication Data

US 2023/0118537 A1 Apr. 20, 2023

(51) Int. Cl.

| | |
|---|---|
| ***F24C 1/16*** | (2021.01) |
| ***F24B 1/20*** | (2006.01) |
| ***F24C 15/00*** | (2006.01) |
| *F24B 1/24* | (2006.01) |

(52) U.S. Cl.

CPC ..... *F24B 1/205* (2013.01); *F24C 1/16* (2013.01); *F24C 15/001* (2013.01); *F24C 15/006* (2013.01); *F24B 1/24* (2013.01)

(58) Field of Classification Search

CPC ..... F24C 1/16; F24C 15/001; F24C 15/006; F24B 1/205; F24B 1/24; F24B 1/1952; F24B 1/022; F24B 5/026; C10B 1/02; A47J 33/00; A47J 37/07

See application file for complete search history.

(56) References Cited

U.S. PATENT DOCUMENTS 617,696 A * 1/1899 Hitchcock ..... F24B 1/205 126/275 R
4,455,992 A * 6/1984 Hsiao ..... F24B 1/205 126/9 R
5,437,222 A * 8/1995 Franklin ..... A47J 33/00 99/450
5,495,845 A * 3/1996 Hait ..... F24C 1/02 126/29
10,441,109 B2 * 10/2019 Huang ..... A47J 37/079
2014/0069418 A1 * 3/2014 Merkurieff ..... A47J 33/00 126/9 R
2014/0326231 A1 * 11/2014 Despain ..... A47J 33/00 126/65
2014/0326720 A1 * 11/2014 Probst ..... F24B 1/205 220/6
2017/0049265 A1 * 2/2017 Heuchling ..... A47J 37/0763
(Continued)

OTHER PUBLICATIONS

Alvintest "Sheet Metal Rocket Stove" YouTube video posted Jan. 1, 2013; https://youtu.be/Fjpv6C6c-_A?si=IWGa1LKosQbkzG5g (Year: 2013).*

(Continued)

*Primary Examiner* — Alfred Basichas
(74) *Attorney, Agent, or Firm* — Bradley Fox

(57) ABSTRACT

A portable stove for burning biomass fuels. The stove has an outer body with walls coupled together with hinges and an opening to load fuel into the stove. The stove further includes a combustion chamber with walls coupled together with hinges that fits within the outer body. The combustion chamber has an opening for loading fuel, secondary openings along upper portions of the walls, a floor with openings to permit airflow into the chamber, and upright posts along the walls to support a cooking utensil for heating. The stove also has a dam that rests on the top of the combustion chamber to direct air through the secondary openings and into the combustion chamber to improve the burning of fuel. The outer body and combustion chamber hinges permit the stove to fold for better storage and transport.

15 Claims, 8 Drawing Sheets

(56) References Cited

U.S. PATENT DOCUMENTS

| | | | | |
|---|---|---|---|---|
| 2017/0328571 | A1* | 11/2017 | Despain | F24B 1/205 |
| 2021/0063019 | A1* | 3/2021 | James | F24B 1/202 |
| 2021/0372625 | A1* | 12/2021 | Fitzgibbins | F24B 1/182 |
| 2022/0160166 | A1* | 5/2022 | Zhang | F24B 1/028 |

OTHER PUBLICATIONS

Ganesha Cookstove Project "Ganesha Cookstove Assembly Instructions—Nepali" YouTube video posted Dec. 5, 2018; https://youtu.be/5c92GKNOStY?si=w3PZTg0OmFTLW8fZ (Year: 2018).*

* cited by examiner

PORTABLE STOVE

FIELD OF THE INVENTION

This invention relates to portable stoves. Specifically, this invention is directed at portable stoves that burn biofuels and are lightweight and foldable for use outdoors and while traveling, camping, and backpacking.

BACKGROUND ART

While enjoying the outdoors, portable stoves are often used to cook food, boil water, or provide heat. Very often, these stoves require gas fuels such as propane or butane. One drawback with these stoves is that if one forgets the fuel or if one runs out of fuel then the stove will not work.

There also exist stoves that burn biomass fuels, such as wood, to provide heat for cooking or warmth. These stoves, however, often do not heat quickly, are inefficient, or are not easily transportable or storable. These stoves either have a single air intake that fails to efficiently burn biomass fuels, or they are cylindrical in shape so that they cannot be completely folded flat for transport or storage. The cylindrical shape consumes more space in a backpack or other container. Thus, what is needed is a portable stove that heats well, burns fuel efficiently, and folds flat for better transport or storage.

SUMMARY OF THE INVENTION

The current invention relates to a portable stove that folds flat for convenient transport and storage and burns biomass fuels efficiently through a double wall design that includes a primary air intake for primary combustion and the addition of a secondary air supply for more complete burn of the combustible gases. The secondary air supply increases the efficiency of the stove as compared to a stove designed without secondary air supply.

The stove has a foldable walled outer body with an opening to load fuel into the stove. The stove further includes a foldable walled combustion chamber that fits within the outer body. The combustion chamber is of a size that creates a space between the walls of outer body and the walls of the combustion chamber when the stove is assembled. The combustion chamber generally has an opening for loading fuel into the chamber, a floor, a plurality of secondary air openings along an upper portion of the walls of the chamber, and upright posts along the walls of the combustion chamber, which can support a cooking utensil for heating. The stove also has an air dam that rests on the top of the combustion chamber to direct air flow from the space between the walls of the outer body and the walls of the combustion chamber through the secondary air openings in the combustion chamber to supply pre-heated secondary air into the combustion chamber and improve the burning of fuel.

The outer body is generally rectangular in shape with its walls coupled together with hinges. The hinges permit the outer body to fold flat. In one embodiment, hinges on opposite corners of the rectangular shape are offset so that when the outer body folds flat, there is space between its walls to store the other components of the stove. The walls of the outer body typically have one or more openings along the bottom portion of the wall to permit air intake through the walls.

One or more walls of the outer body may also contain openings for loading fuel. In an embodiment of the portable stove, the outer body has one wall with an opening for loading fuel into the combustion chamber of the stove. The walls of the outer body are typically made from a rigid, fireproof material. The walls of the outer body may also be embossed to increase the strength and rigidity of the walls. Each wall may also be comprised of individual wall segments that may permit the outer body to collapse to a smaller size.

The combustion chamber is generally rectangular in shape with its four walls coupled by hinges to permit the combustion chamber to fold. In one embodiment, the combustion chamber is the same shape but proportionally smaller than the outer body such that a relatively uniform space is created between the walls of the outer body and the walls of the combustion chamber when the stove is assembled. In another embodiment, the walls of the combustion chamber are smaller than the walls of the outer body by different dimensions creating an uneven space between the walls of the outer body and the walls of the combustion chamber. One wall of the combustion chamber typically has an opening for loading fuel into the combustion chamber that matches the opening for loading fuel in the outer body. In another embodiment, neither the outer body nor the combustion chamber have openings in the walls for loading fuel, and the fuel is fed through the opening at the top of the stove.

The combustion chamber may have a floor upon which the fuel is placed. The floor of the combustion chamber may be pivotally coupled to a wall of the combustion chamber so that the floor can fold up against the wall when the combustion chamber is folded and then fold down when the stove is assembled. The floor may have one or more openings to permit air to flow into the interior of the combustion chamber through the floor. In one embodiment, the opening for loading fuel into the combustion chamber is positioned above the lower edge of the wall of the combustion chamber and the floor generally rests at the lower edge of the fuel opening thus creating a space between the floor of the combustion chamber and a support surface. The floor may rest on tabs along the walls to support the floor above the base of the stove. In such an embodiment, a space will exist between the floor of the combustion chamber and the support surface of the stove. In an alternative embodiment, the combustion chamber has no floor, or the floor may be flush with the supporting surface, and fuel is placed either upon the surface supporting the stove or the floor.

The walls of the combustion chamber may further have several secondary air openings along their upper portions. These secondary air openings are used to allow pre-heated secondary air to be supplied into the combustion chamber in coordination with the air dam. The walls of the combustion chamber also have upright supports to hold a cooking utensil when in use. In one embodiment, one support is placed along each wall to hold a vessel above the combustion chamber.

The walls of the combustion chamber are typically made from a rigid, fireproof material. The walls of the combustion chamber may also be embossed to increase the strength and rigidity of the walls. Each wall may also be comprised of individual wall segments that may permit the combustion chamber to collapse to a smaller size.

The air dam blocks off the space between the outer body walls and the combustion chamber walls, forcing air in that space through the secondary air openings in the upper portions of the combustion chamber walls, and allowing the stove to burn the combustible gases more efficiently. The air dam also contains an opening to permit flame and exhaust gases to rise from the combustion chamber. Typically, the air dam is rectangular shape, and rests upon the edges of the walls of the combustion chamber. The air dam may contain cutouts that permit it to slide past the upright supports and be retained by the supports. The air dam is generally flat and can be stored in the outer body for storage and transport.

The stove is assembled by unfolding the combustion chamber, positioning the floor in the combustion chamber, unfolding the outer body and ensuring it is positioned surrounding the combustion chamber so that the fuel openings are aligned, and locating the air dam in place along the upper edge of the combustion chamber wall. The stove is collapsed by reversing these steps: first the air dam is removed, the combustion chamber is folded, and then the outer body is folded. In one embodiment, the hinges of the outer body are offset on opposite corners so that the outer body folds leaving space between the walls. In this embodiment, the components of the stove can be stored inside the outer body.

The stove operates when assembled by first loading biomass fuel through the fuel openings of the outer body and the combustion chamber and into the interior of the chamber. Fuel can also be loaded through the top of the stove in an embodiment without a fuel opening in the wall of the outer body and combustion chamber. The stove is positioned to draw air through the openings in the outer body. When the fuel is lit, primary air for combustion is drawn into the combustion chamber to burn the fuel through the fuel opening and the openings in the floor. Secondary air is drawn up between the walls of the outer body and the walls of the combustion chamber and then forced through the secondary air openings of the combustion chamber walls by the air dam to provide secondary air supply and secondary combustion of the gases inside the combustion chamber to increase the efficiency of the burning of the biomass in the chamber.

BRIEF DESCRIPTION OF THE DRAWINGS

Embodiments of the present invention are illustrated by way of examples and are not limited to the accompanying drawings.

REFERENCE NUMBERS

Figure 1:
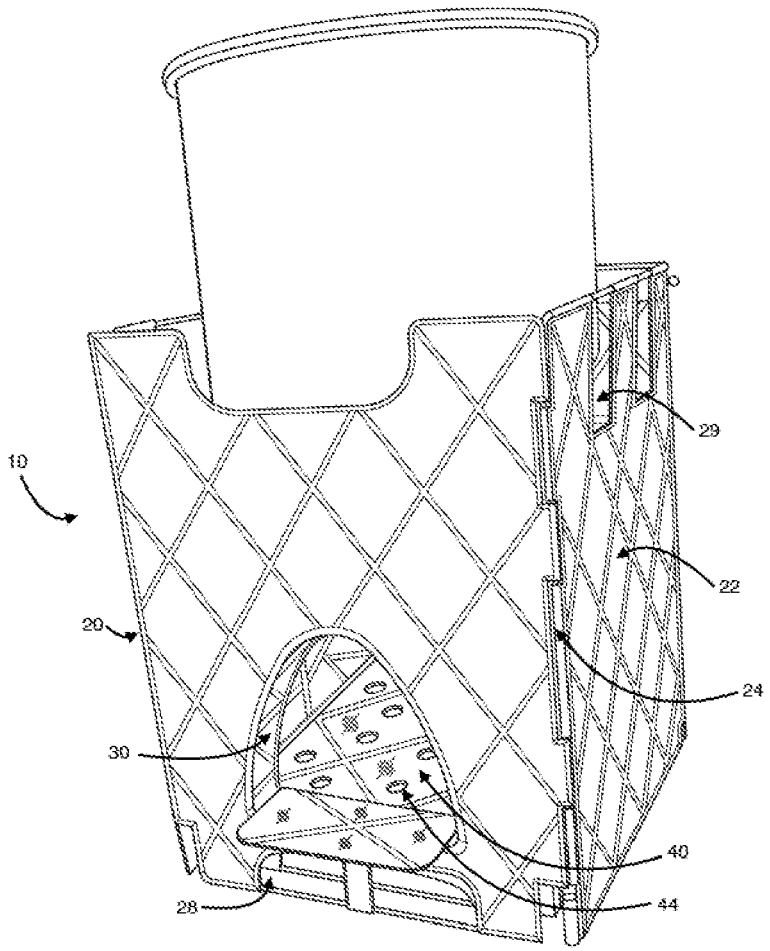
FIG. 1 shows a perspective view of an embodiment of the portable stove.
Figure 2:
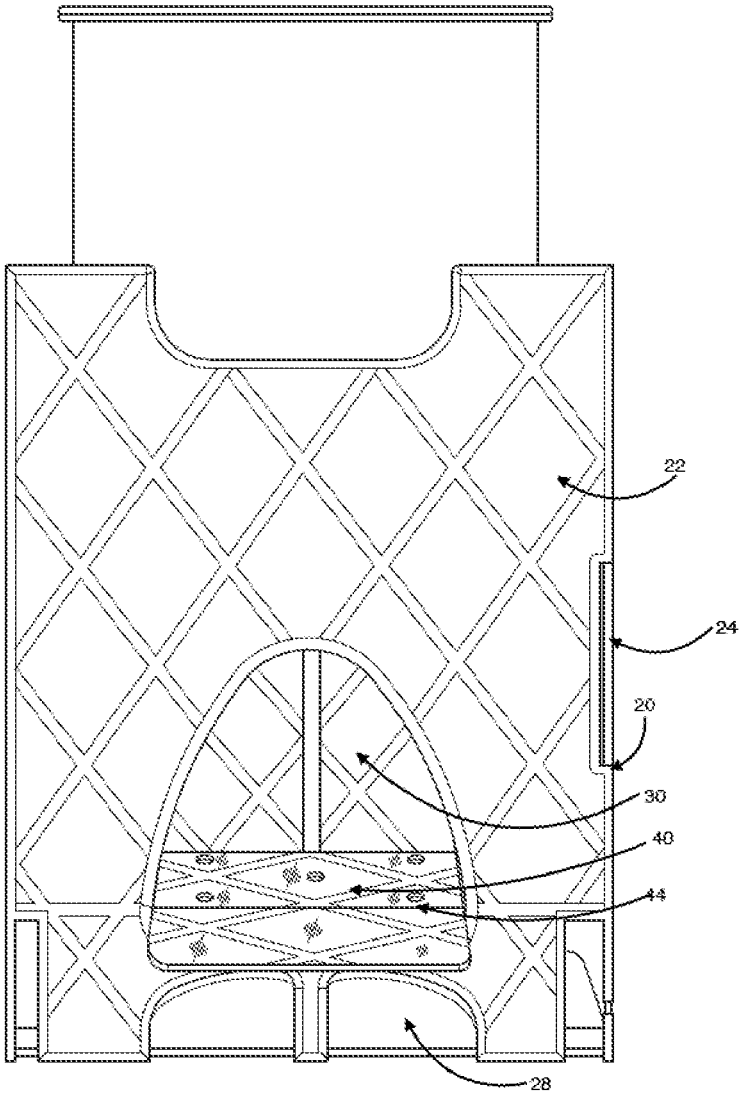
FIG. 2 is a front view of an embodiment of the portable stove.

10—Portable Stove
20—Outer Body
22—Outer Body Wall
24—Outer Body Hinge
26—Outer Body Fuel Opening
28—Outer Body Air Intake Opening
29—Upper Opening
30—Combustion Chamber
32—Combustion Chamber Wall
34—Combustion Chamber Hinge
36—Combustion Chamber Fuel Opening
38—Combustion Chamber Air Intake Openings
40—Combustion Chamber Floor
44—Combustion Chamber Floor Openings
50—Secondary Air Openings
54—Upright Posts
60—Air Dam
62—Air Dam Notch

DETAILED DESCRIPTION OF INVENTION

With reference to FIGS. 1-4, the current invention relates to a portable stove 10 having an outer body 20 with walls 22 and a combustion chamber 30 with walls 32 that fits inside the outer body 20 creating a double walled stove capable of burning biomass fuels. Walls 22 of the outer body 20 are coupled by hinges 24 to permit the outer body 20 of the stove 10 to fold when not in use. Likewise, the walls 32 of the combustion chamber 30 are coupled by hinges 34 to permit the combustion chamber 30 of the stove 10 to fold when not in use. Thus, the stove 10 can be folded for better storage.

Figure 3:
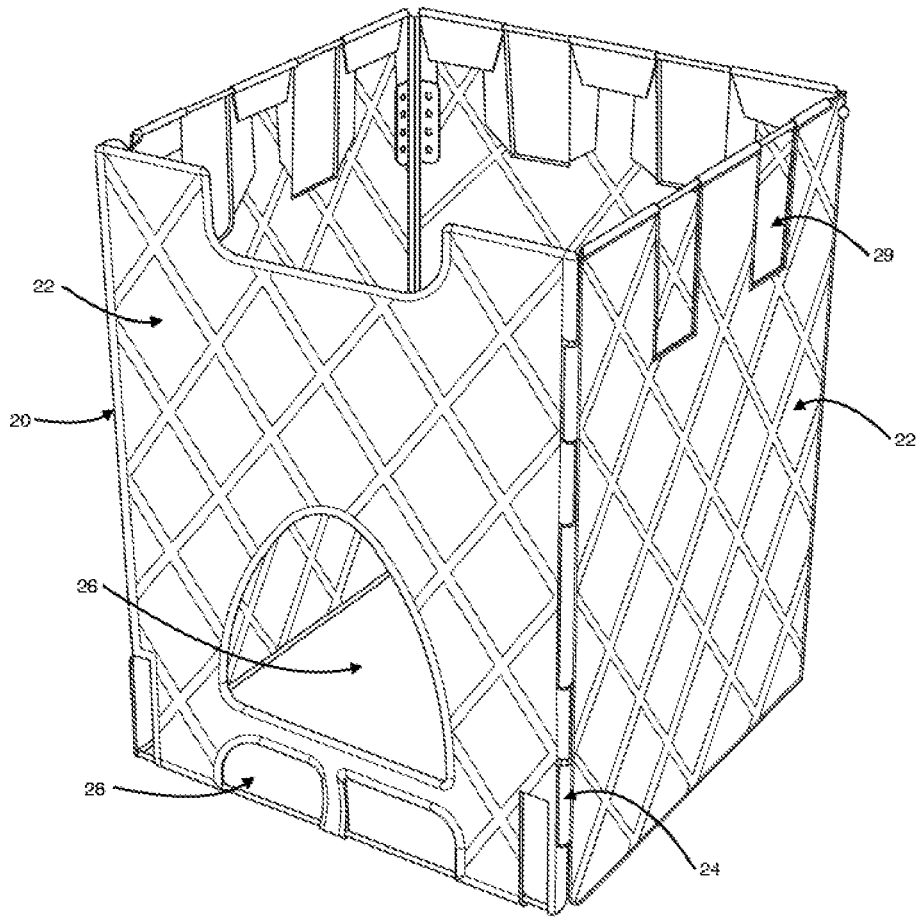
FIG. 3 is a perspective view of an embodiment of the outer body of the portable stove.

Referring to FIG. 3, The outer body 20 is generally rectangular in shape. In an embodiment of the present invention, one wall 22 of the outer body 20 has a fuel opening 26 to load fuel into the stove. In an alternative embodiment, the opening 26 is omitted and fuel is loaded into the stove through the top of the stove 10. The outer body 20 further includes a plurality of air intake openings 28 along the lower portions of the walls 22. The openings 28 are typically located below the fuel opening 26 along the base of the walls 22. The outer body may have greater or fewer openings 28 for air intake located around the base of the outer body 20. The walls 22 of the outer body 20 are typically made from a rigid, fireproof material. The walls 22 of the outer body 20 may also be embossed to increase the strength and rigidity of the walls. Walls 22 may also be comprised of individual wall segments that may permit the outer body 20 to collapse to a smaller size. In such an embodiment, each segment would be hingedly coupled together. Walls 22 may have openings 29 along the upper portion to permit flame and exhaust gases to leave the stove 10.

Walls 22 are coupled using hinges 24. The hinges 24 may be of any design that allows the walls 22 to fold. In one embodiment, the hinges 24 are offset in opposite corners so that when the walls 22 of the outer body 20 fold flat, there remains a cavity between the walls 22 to store the remaining components of the stove 10 inside the collapsed outer body 20.

Figure 4:
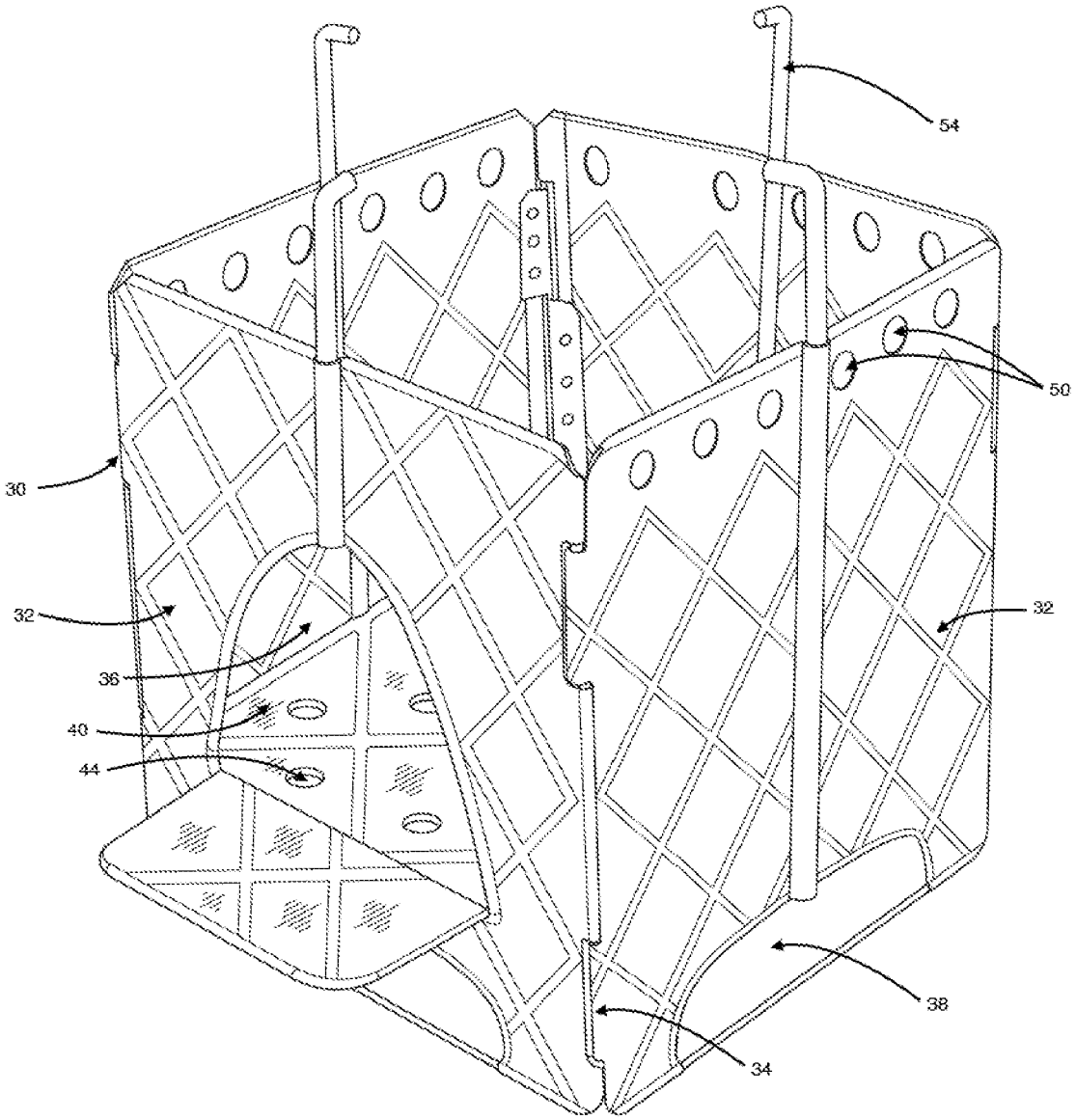
FIG. 4 is a perspective view of an embodiment of the combustion chamber of the portable stove.
Figure 5:
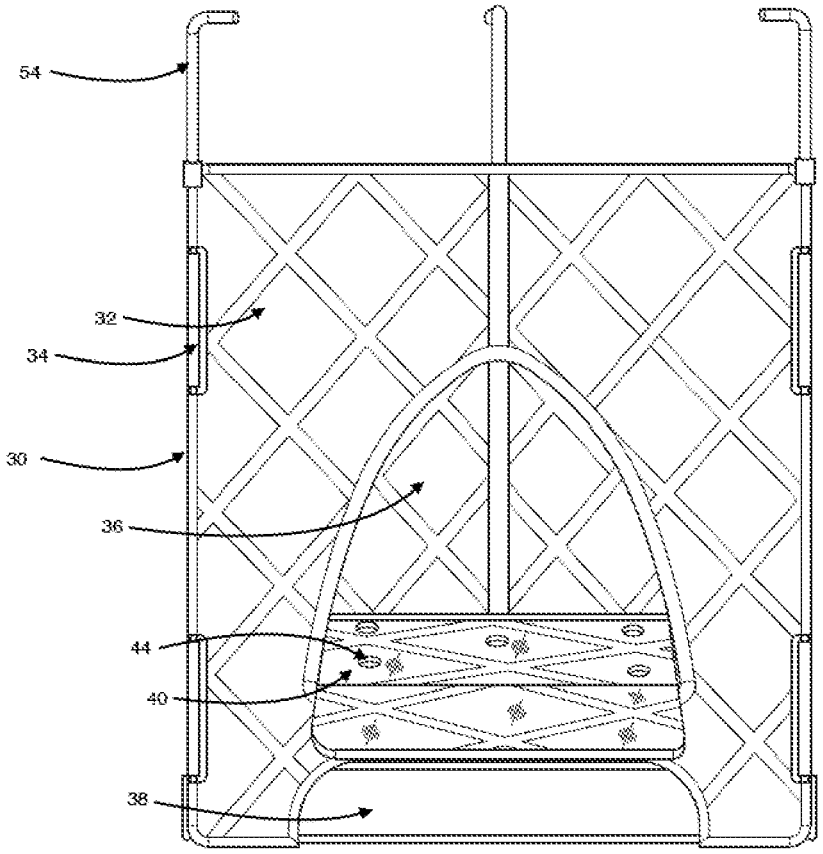
FIG. 5 is a front view of an embodiment of the combustion chamber of the portable stove.
Figure 6:
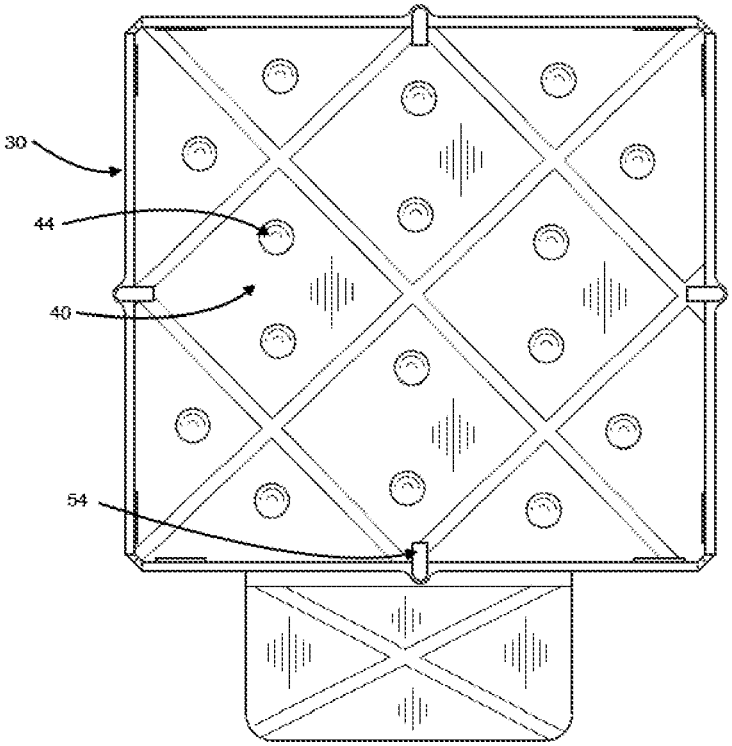
FIG. 6 is a top view of an embodiment of the combustion chamber of the portable stove.

Referring to FIG. 4, the combustion chamber 30 is generally rectangular in shape and fits within the outer body 20. In one embodiment, the combustion chamber 30 is the same shape but proportionally smaller than the outer body 20 so that a relatively uniform space may be created between the walls 22 of the outer body 20 and the walls 32 of the combustion chamber 30 when the stove is assembled. In another embodiment, the walls of the combustion chamber 30 are smaller than the walls of the outer body 20 by different dimensions creating an uneven space between the walls 22 of the outer body 20 and the walls 32 of the combustion chamber 30.

On one wall 32, the combustion chamber has an opening 36 for loading fuel into the chamber 30. The chamber may have more than one opening 36. In an alternative embodiment, the opening 36 is omitted and fuel is loaded into the stove through the top of the stove 10. Typically, the opening 36 is positioned along the wall 32 so that it may align with the opening 26 in the outer body 20 when the stove 10 is assembled.

Figure 8:
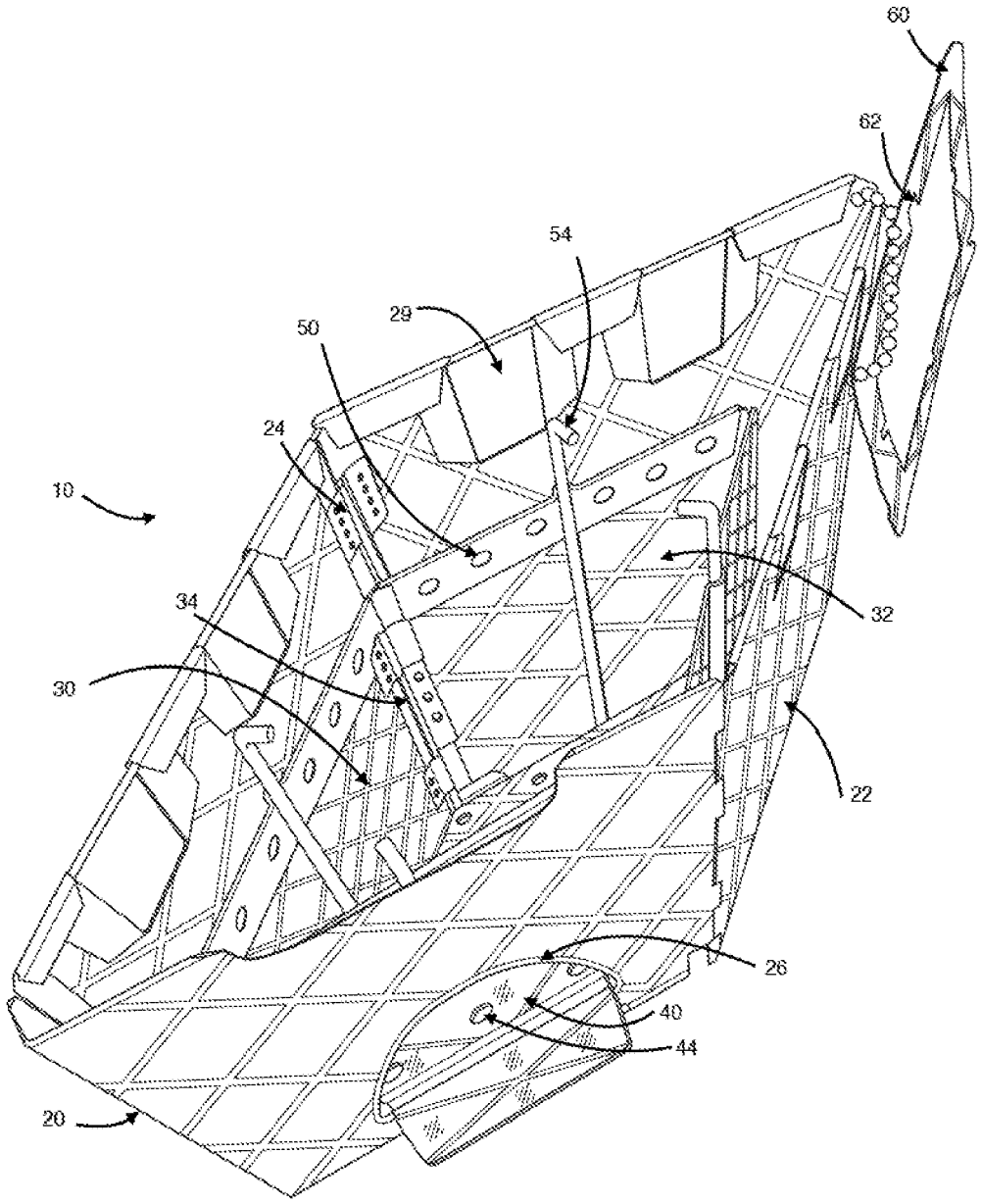
FIG. 8 is a perspective view of the portable stove folded inside the outer body.

As shown in FIG. 4, in an embodiment of the invention, the combustion chamber 30 also may have a floor 40. The floor 40, as shown in FIG. 8, is pivotally coupled to one wall 32 to permit the floor 40 to fold when the stove 10 is collapsed. The floor 40 is positioned above the lower edges of the walls 32 so that a space exists between the floor 40 and the support surface for the stove 10. The floor 40 has a plurality of openings 44 to allow air to travel from the space below the floor into the combustion chamber 30. Further, the walls 32 of the combustion chamber 30 also typically have air intake openings 38 along the lower portion of the walls 32. The openings 38 permit air to enter the space below the floor and enter the combustion chamber 30 through floor openings 44.

The walls 32 of the combustion chamber 30 also have a plurality of secondary air openings 50 along the upper portion of the walls 32. The secondary air openings 50 permit air traveling in the space between the walls 22 of the outer body 20 and the walls 32 of the combustion chamber 30 to be supplied into the combustion chamber 30 allowing secondary burn and improving fuel efficiency. The combustion chamber 30 also has upright posts 54 secured along the walls 32 to support a cooking utensil for heating. The posts 54 are typically welded to the walls 32 but may be attached by other techniques. The upright posts 54 are typically rod shaped with a bent end for a cooking utensil to rest on, but they may be any shape capable of supporting a cooking utensil over the combustion chamber 30. In an alternative embodiment, the combustion chamber 30 does not include upright posts 54, and a cooking utensil may be placed upon the walls 22 of the outer body 20. A cooking utensil may also be placed upon a grill that is placed upon the walls 22 of the outer body 20.

The walls 32 are typically made from a rigid fireproof material. The walls 32 may also be embossed to increase the strength and rigidity of the walls. Walls 32 may also be comprised of individual wall segments that may permit the combustion chamber 30 to collapse to a smaller size. In such an embodiment, each segment would be hingedly coupled together. It is understood that the walls 32 may have a greater or fewer number of openings than shown in the figures.

The floor 40 is typically a rigid, fireproof platform the same size as the opening created by the walls 32 forming the combustion chamber 30. The floor 40 may be embossed to increase strength. In one embodiment, the floor 40 is pivotally coupled to wall 32 and supported on a bar or raised support along the opposing wall 32. The floor 40 may be folded to permit the combustion chamber 30 to fold flat. In another embodiment, the floor 40 may be a separate component that rests upon small tabs on each wall 32. The floor 40 may also extend through the opening 36 and the opening 26 to provide a base for fuel being placed into the combustion chamber 30 and alignment between the outer body 20 and the combustion chamber 30.

Figure 7:
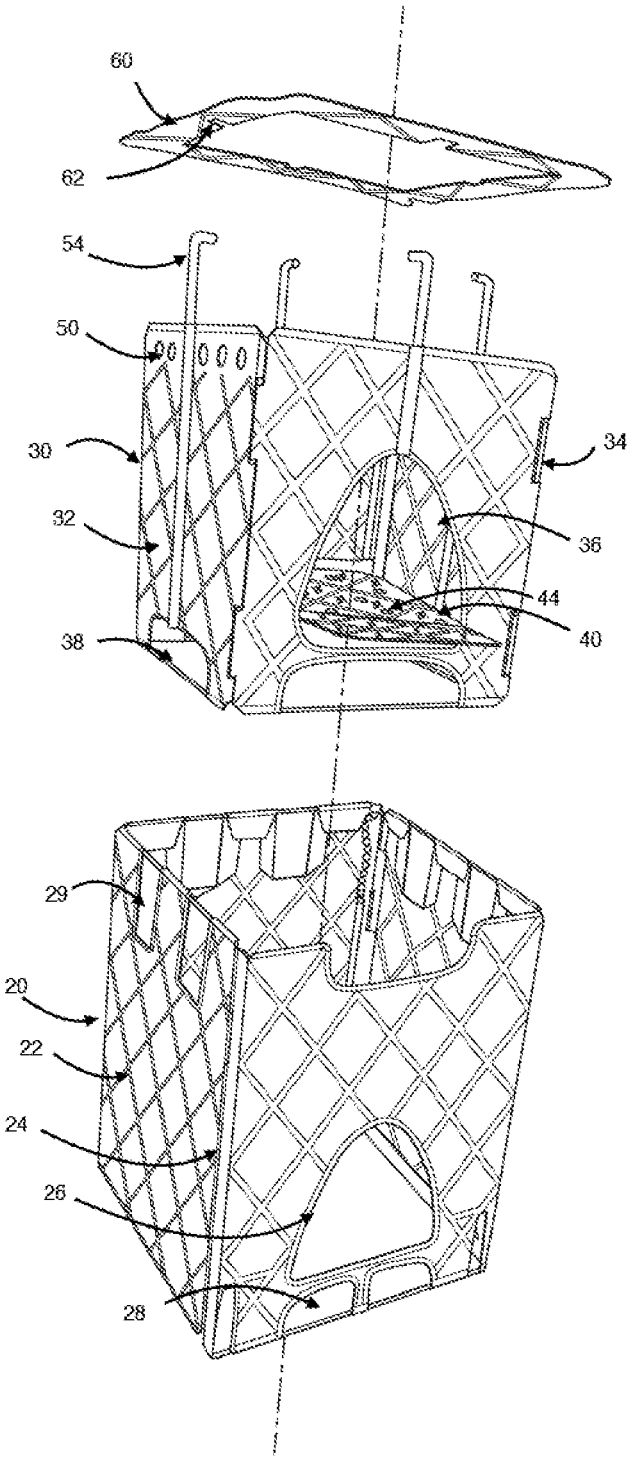
FIG. 7 is a perspective view of the portable stove disassembled.

When the combustion chamber 30 is located inside the outer body 20, the double walled stove 10 is prepared for use. To improve the efficiency of the stove 10, an air dam 60 is positioned upon the upper edge of the walls 32. The air dam 60 blocks air coming up in the space between the walls 22 of the outer body 20 and the walls 32 of the combustion chamber 30 and directs the air through the secondary air openings 50 to supply secondary air to the combustion chamber 30 and increase combustion of the gases in the combustion chamber 30. The air dam 60 also has an opening to permit flame and exhaust gases to exit the combustion chamber 30. The air dam 60 is typically a shape to match the shape of the outer body 20 and the combustion chamber 30. The air dam 60, when removed, can be stored inside the stove 10 when collapsed. The air dam 60 in one embodiment may be tethered to the outer body 20 by a retaining device so as it cannot be lost. The air dam 60 may have notches 62 to fit around the upright posts 54 to locate and secure the air dam 60 in place as shown in FIG. 7. In one embodiment, a cooking utensil can be placed directly on the air dam 60 and the upright posts 54 can be removed. Additionally, the air dam 60 may be any structure that blocks air traveling in the space between the outer body 20 and the combustion chamber 30 and directs the air through the secondary air openings 50.

To operate the stove 10, the stove 10 is assembled by locating the unfolded combustion chamber 30 inside the unfolded outer body 20. The floor 40 of the combustion chamber 30, in an embodiment with a floor is positioned in place. Fuel is placed through the openings 26 and 36, or through the top of the stove, and into the combustion chamber 30. When the fuel is lit, air is drawn through the air intake openings 28 and 38 and drawn through the plurality of floor openings in the floor 44. Air may also be introduced into the combustion chamber 30 through the fuel openings 26 and 36. As the fire continues to burn, air is drawn through the space between the walls 32 of the combustion chamber 30 and the walls 22 of the outer body 20. The air is blocked by the air dam 60 and directed through the secondary air openings 50 and supplied to the combustion chamber 30. The air supplied to the combustion chamber 30 through the secondary air openings 50 increases the efficiency of the stove by facilitating the secondary burning of gases in the combustion chamber 30. A cooking utensil may be placed upon the upright posts 54 or on the top of the outer body 20 and heated.

It will be understood that the foregoing relates to exemplary embodiments of the invention and that modifications may be made without departing from the spirit and scope of the invention as set forth in the following claims.

What is claimed is:

1. A portable stove comprising:

a rectangular outer body having walls coupled together with hinges that allow the outer body to fold and an opening in at least one wall for loading fuel;

a rectangular combustion chamber located inside the outer body such that there is space between the outer body and the combustion chamber, the combustion chamber having walls coupled together with hinges that allow the combustion chamber to fold, an opening in at least one wall for loading fuel into the combustion chamber, a plurality of secondary air openings along an upper portion of at least one wall of the combustion chamber, and a plurality of upright posts located along the walls of the combustion chamber; and an air dam configured to extend over the upper edge of the walls of the combustion chamber to improve the confinement of gases in the combustion chamber so that air is drawn from outside the outer body and through the space between the outer body and the combustion chamber and through the secondary air openings in the wall of the combustion chamber to create a secondary burn of gases within the combustion chamber, the air dam further having an opening to permit flame and exhaust gases to exit the combustion chamber.

2. The portable stove of claim 1 wherein the outer body includes an air intake opening along at least one wall of the outer body.

3. The portable stove of claim 2 wherein the combustion chamber includes an air intake opening along a lower portion of at least one wall of the combustion chamber.

4. The portable stove of claim 3 wherein the combustion chamber further includes a floor with a plurality of openings and the floor is located above the air intake opening of the combustion chamber.

5. The portable stove of claim 4 wherein the floor of the combustion chamber is pivotally coupled to a wall of the combustion chamber.

6. The portable stove of claim 1 wherein the air dam has notches that fit around the upright posts to locate and secure the air dam.

7. A portable stove comprising:

a rectangular outer body having walls coupled together with offset hinges that permit the stove to fold leaving a cavity between the walls and an opening in at least one wall for loading fuel;

a rectangular combustion chamber located inside the outer body such that there is space between the outer body and the combustion chamber, the combustion chamber having walls coupled together with hinges that allow the combustion chamber to fold, an opening in at least one wall for loading fuel into the combustion chamber, a floor configured to rest inside the combustion chamber, a plurality of secondary air openings along an upper portion of at least one wall of the combustion chamber, and a plurality of upright posts located along the walls of the combustion chamber;

an air dam configured to extend over the upper edge of the walls of the combustion chamber to improve the confinement of gases in the combustion chamber so that air is drawn from outside the outer body and through the space between the outer body and the combustion chamber and through the secondary air openings in the wall of the combustion chamber to create a secondary burn of gases within the combustion chamber, the air dam further having an opening to permit flame and exhaust gases to exit the combustion chamber; and whereas the combustion chamber and air dam fit within the outer body when the stove is folded.

8. The portable stove of claim 7 wherein the outer body includes an air intake opening along at least one wall of the outer body.

9. The portable stove of claim 8 wherein the combustion chamber includes an air intake opening along a lower portion of at least one wall of the combustion chamber.

10. The portable stove of claim 9 wherein the floor has a plurality of openings and is located above the air intake opening of the combustion chamber.

11. The portable stove of claim 7 wherein the floor of the combustion chamber is pivotally coupled to a wall of the combustion chamber.

12. The portable stove of claim 7 wherein the air dam has notches that fit around the upright posts to locate and secure the air dam.

13. A method of heating a portable stove comprising:

unfolding an outer body until it forms a rectangular shape, the outer body having walls coupled together with hinges and an opening in at least one wall for loading fuel;

locating a rectangular combustion chamber inside the outer body such that there is space between the outer body and the combustion chamber, the combustion chamber having walls coupled together with hinges that permit the combustion chamber to fold, an opening in one wall for loading fuel into the combustion chamber that aligns with the opening in the outer body, a floor, a plurality of secondary air openings along an upper portion of at least one wall of the combustion chamber, and a plurality of upright posts located along the walls of the combustion chamber;

placing an air dam configured to extend over the upper edge of the walls of the combustion chamber to improve the confinement of gases in the combustion chamber so that air is drawn from outside the outer body and through the space between the outer body and the combustion chamber and through the secondary air openings in the wall of the combustion chamber to create a secondary burn of gases within the combustion chamber, the air dam further having an opening to permit flame and exhaust gases to exit the combustion chamber; and loading fuel into the combustion chamber and lighting the fuel with a source such that the heat from the lit fuel draws air through the combustion chamber to continue to burn fuel.

14. The method of claim 13 wherein the outer body further includes an air intake opening along at least one wall of the outer body, the combustion chamber further includes an air intake opening along at least one wall of the combustion chamber; and the floor is positioned above the air intake opening of the combustion chamber and has a plurality of openings to permit greater air flow into the combustion chamber so that as the fuel continues to burn, additional air is drawn into the combustion chamber.

15. The portable stove of claim 13 wherein the air dam has notches that fit around the upright posts to locate and secure the air dam.

* * * * *